US007103296B2

(12) United States Patent
Kiyosumi et al.

(10) Patent No.: US 7,103,296 B2
(45) **Date of Patent: *Sep. 5, 2006**

(54) IMAGE FORMING APPARATUS WITH FUNCTION OF SORTING PLURALITY OF SHEAVES OF ORIGINAL PAPER

(75) Inventors: Tadahiro Kiyosumi, Tenri (JP); Masaki Tsuchiya, Izumi (JP); Izumi Kadobayashi, Izumi (JP); Masaki Kato, Soraku-gun (JP); Norihisa Yamashita, Kobe (JP); Mitsuyuki Kishimoto, Osaka (JP)

(73) Assignee: Kyocera Mita Corporation, (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/210,609

(22) Filed: Aug. 23, 2005

(65) Prior Publication Data

US 2005/0281578 A1 Dec. 22, 2005

Related U.S. Application Data

(62) Division of application No. 10/680,991, filed on Oct. 8, 2003, now Pat. No. 6,954,599.

(30) Foreign Application Priority Data

Nov. 10, 2002 (JP) ..... 2002-299465

(51) Int. Cl.
*G03G 15/00* (2006.01)

(52) U.S. Cl. ..... 399/82; 399/81; 399/403; 399/407

(58) Field of Classification Search ..... 399/81, 399/82, 397, 403, 404, 405, 407, 408, 410
See application file for complete search history.

(56) References Cited

U.S. PATENT DOCUMENTS

| | | | | |
|---|---|---|---|---|
| 4,961,092 | A | 10/1990 | Rabb et al. | |
| 5,262,831 | A | 11/1993 | Iwata | |
| 5,848,325 | A | 12/1998 | Matsumura | |
| 6,041,199 | A * | 3/2000 | Kashimada | 399/82 |
| 6,311,029 | B1 | 10/2001 | Sumio et al. | |
| 6,337,970 | B1 | 1/2002 | Okamoto et al. | |
| 6,356,719 | B1 | 3/2002 | Yoshiura | |
| 6,954,599 | B1 * | 10/2005 | Kiyosumi et al. | 399/82 |

FOREIGN PATENT DOCUMENTS

| | | |
|---|---|---|
| JP | 8-248-698 | 9/1996 |
| JP | 2001-226025 | 8/2001 |

* cited by examiner

*Primary Examiner*—Sandra L. Brase
(74) *Attorney, Agent, or Firm*—Gerald E. Hespos; Anthony J. Casella

(57) ABSTRACT

An image forming apparatus includes: an image forming section; a discharger for discharging and guiding the copying paper to an outlet; and a controlling section for operating the image forming section, based on an image forming instruction from an operation section. A data fetching section fetches first image data on a plurality of pages and second image data on a plurality of pages. The operation section accepts, as the image forming instruction, a sheaf-unit sorting instruction which includes a predetermined number of copies of each of the first image data and second image data and sorting of the copies. The controlling section, based on the sheaf-unit sorting instruction executes, for the predetermined number of copies, an operation of guiding the first and second sheafs of copying paper, in sequence, to the outlet so that the first sheaf and second sheafs of copying paper are piled in order.

12 Claims, 13 Drawing Sheets

IMAGE FORMING APPARATUS WITH FUNCTION OF SORTING PLURALITY OF SHEAVES OF ORIGINAL PAPER

This application is a divisional of U.S. patent application Ser. No. 10/680,991 filed on Oct. 8, 2003 now U.S. Pat. No. 6,954,599.

BACKGROUND OF THE INVENTION

1. Field of the Invention

This invention relates to an image forming apparatus which has sorting and other functions.

2. Description of the Related Art

Conventionally, there is an image forming apparatus such as a copying machine which has a sorting function. In such an apparatus, sheets of copying paper where each image on sheets of original paper has been copied are arranged in the same page order as the sheets of original paper, and then, finishing processing such as stapling processing of each sheaf of the sheets of copying paper is conducted before the sheaves are discharged, so that a predetermined number of copies can be made in each sheaf (for example, refer to Japanese Patent Laid-Open No. 08-248698 specification and Japanese Patent Laid-Open No. 2001-226025 specification).

Using such a sorting function, for example, if a set of original paper made up of three kinds of original-paper sheaves is copied, the sorting function is used three times to copy each kind of original-paper sheaf one by one. Then, finishing processing is conducted of each of three kinds of sheaves of paper on which their originals have been copied. As a result, required copies can be obtained for each kind of original-paper sheaf. FIG. 11 is an illustration showing an example of the result of an output obtained if three copies of original paper made up of three kinds of original-paper sheaves A, B, C are made using the sorting function. In this case, the original-paper sheaf A is copied, stapling processing is conducted of each of three sheaves of paper on which the sheaf A has been copied, and the three sheaves are outputted as one set. With respect to the original-paper sheaves B, C, a set of three sheaves of paper is outputted in the same way, respectively.

However, after obtaining the set of three sheaves of copied paper, a user needs to manually sort the sheaves, A, A, A, B, B, B, C, C, C of copies according to an order of original-paper sheaves, A, B, C. Thus especially when the number of sheaves of the original document is great and/or the number of copies to be made is large, the user's manual sorting task, after completion of copying job by a copy machine, becomes a time-consuming, thereby markedly lowering an efficiency in an copying operation as a whole.

SUMMARY OF INVENTION

It is an object of the present invention to provide an image forming apparatus which is capable of copying a set of original paper made up of a plurality of sheaves of original paper, arranging a plurality of sheaves of copying paper on which images of the original paper have been copied in the same order as the sheaves of original paper, and sorting and discharging the sheaves of copying paper as one set.

In order to attain the object, the image forming apparatus according to the present invention, comprising: an image forming section for copying image data of each page onto copying paper; a discharger for discharging the copying paper after the copying, and guiding the copying paper to an outlet portion; an operation section in which an instruction related to image forming is inputted by a user; and a controlling section for operating the image forming section, based on an image forming instruction from an operation section, wherein: a data fetching means is provided which fetches first image data on a plurality of pages and second image data on a plurality of pages; the operation section accepts, as the image forming instruction, a cascade sorting instruction which includes a predetermined number of copies of each of the first image data and second image data and sorting of the copies; and the controlling section, based on the cascade sorting instruction from the operation section, executes, for the predetermined number of copies, an operation of guiding the first sheaf of copying paper and the second sheaf of copying paper, in sequence, to the outlet portion so that the first sheaf of copying paper and the second sheaf of copying paper are piled in this order.

These and other objects, features and advantages of the present invention will become more apparent upon reading of the following detailed description along with the accompanied drawings.

DESCRIPTION OF THE PREFERRED EMBODIMENTS

Figure 1:
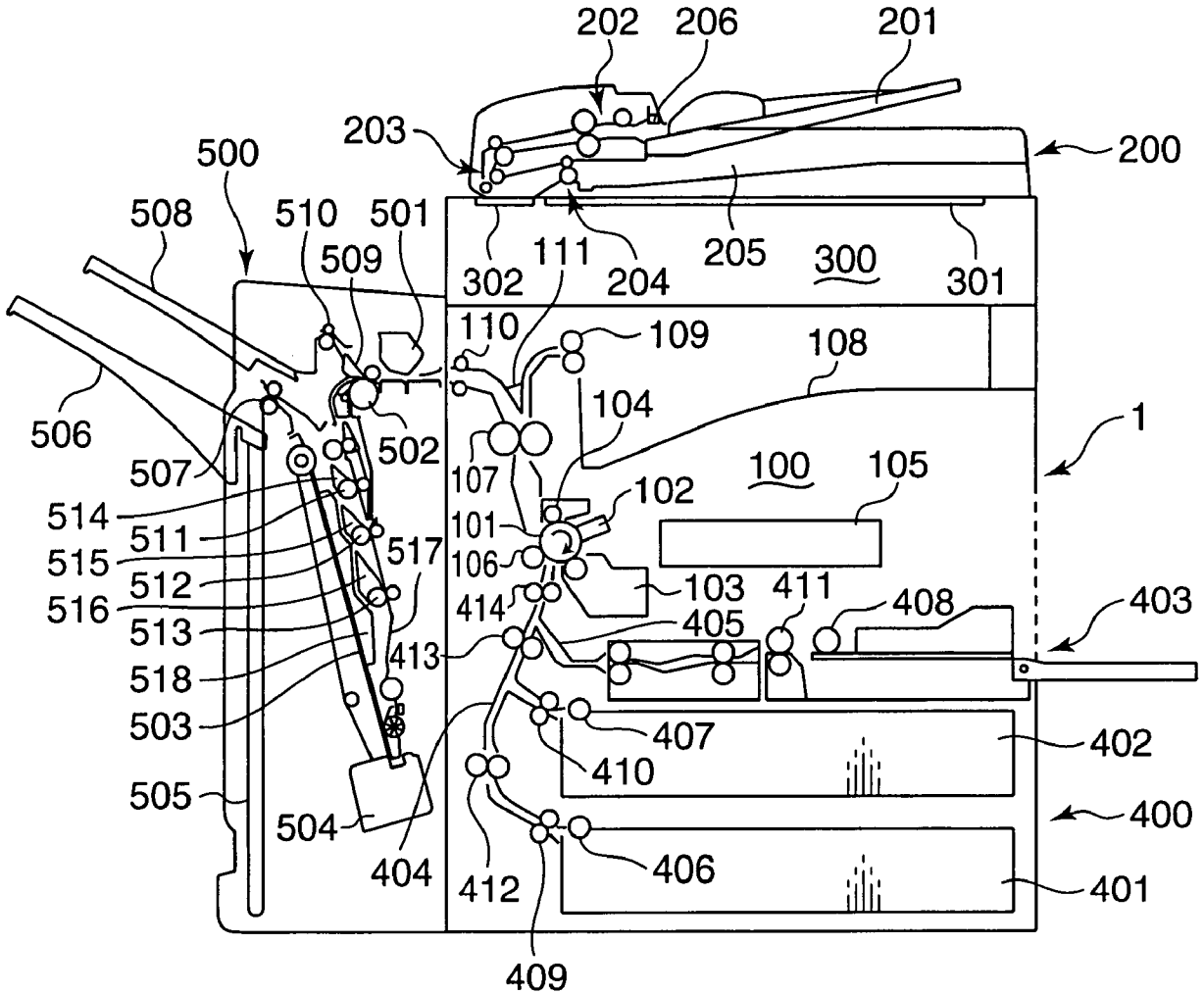
FIG. 1 is a front sectional view of an image forming apparatus according to an embodiment of the present invention.

FIG. 1 is a front sectional view of an image forming apparatus according to an embodiment of the present invention. This image forming apparatus is configured by a copying machine or the like which comprises: a copying-machine main body 1 including an image forming section 100; an original-paper forwarding mechanism 200 and an original-paper reading section 300 provided over the copying-machine main body 1, which are also used to hold original paper; a paper feeding section 400 which is provided under the copying-machine main body 1; and an after-processing section 500 provided on one side of the copying-machine main body 1.

The original-paper reading section 300 includes a scanner and the like which generate image data from an image on original paper obtained optically. A contact glass 301 and a contact glass 302 are provided on the upper surface of the original-paper reading section 300. The original-paper reading section 300 obtains image data from original paper placed on the contact glass 301, or from original paper forwarded by the original-paper forwarding mechanism 200, such that this original paper comes into contact with the contact glass 302. Then, the original-paper reading section 300 outputs the image data to a controlling section 2 (mentioned later).

The original-paper forwarding mechanism 200 includes: an original-paper placement portion 201; a carrying-in drive portion 202 provided with a carrying-in roller pair and the like; a forwarding roller pair 203; a discharging roller pair 204; a discharged-paper receiver 205; and a original-paper detecting switch 206 which detects original paper being placed. The original-paper forwarding mechanism 200 automatically forwards each sheet of original paper placed on the original-paper placement portion 201, one by one, such that the original paper comes into contact with the contact glass 302. Then, the original paper is discharged onto the discharged-paper receiver 205 after being exposed and scanned.

The paper feeding section 400 includes paper feeding cassettes 401, 402 which house each type of copying paper lengthwise and breadthwise, and a manual paper-feeding portion 403. The paper feeding section 400 is provided with a forwarding passageway 404 through which copying paper is forwarded from the paper feeding cassettes 401, 402 to the image forming section 100, and a forwarding passageway 405 through which copying paper is forwarded from the manual paper-feeding portion 403 to the image forming section 100. The paper feeding cassettes 401, 402 and the manual paper-feeding portion 403 are provided with pick-up rollers 406, 407 and 408 which pick up the housed sheets of copying paper, and paper-feeding roller pairs 409, 410 and 411 which send out the sheets of copying paper one by one to the forwarding passageways, respectively.

The forwarding passageway 404 is provided with forwarding roller pairs 412, 413 which forward copying paper, and a resisting roller pair 414 which keeps the forwarded copying paper on standby in a predetermined position before the image forming section 100. The forwarding passageway 405 joins the forwarding passageway 404 on the upstream side from the resisting roller pair 414.

The image forming section 100 includes: a drum-shaped photosensitive body 101 which is supported so that it can rotate; an electrically charging portion 102 disposed at a peripheral part of the photosensitive body 101; a developing portion 103; a cleaning portion 104; a laser scanning unit 105; a copying roller 106; and a fixing roller pair 107. Herein, the electrically charging portion 102 charges the surface of the photosensitive body 101 uniformly to a predetermined potential. The laser scanning unit 105, based on image data transmitted from the controlling section 2, irradiates a laser beam onto the surface of the photosensitive body 101 to form an electrostatic latent image on the surface of the photosensitive body 101.

In addition, the developing portion 103 allows toner to adhere to the electrostatic latent image so that an image can appear. The copying roller 106 copies the appearing toner image onto copying paper. The fixing roller pair 107 fixes the toner image which has been copied onto copying paper. The cleaning portion 104, after the copying, cleans residual toner off the surface of the photosensitive body 101.

In the copying-machine main body 1, a copying-paper outlet portion 108 is provided at its upper part. A discharging roller pair 109 forwards copying paper which has been forwarded from the fixing roller pair 107 and discharges the copying paper to the copying-paper outlet portion 108. In addition, a discharging roller pair 110 discharges copying paper which has been forwarded from the fixing roller pair 107 to the after-processing section 500. Herein, the direction in which this copying paper is discharged can be switched from the side of the discharging roller pair 109 to the side of the discharging roller pair 110, and vice versa. This switching is conducted by a discharge branching guide 111 which is driven according to control signals from the controlling section 2.

The after-processing section 500 includes: a punching portion 501 which conducts, as finishing processing, punching processing of copying paper carried in from the discharging roller pair 110; a carrying-in roller pair 502 which forwards the carried-in copying paper; a copying-paper receiver 503 which temporarily stocks the forwarded copying paper as a sheaf of copying paper; a stapling processing portion 504 which conducts, as finishing processing, stapling processing of the sheaf of copying paper; an outlet tray 506 used for sorting which can be moved up and down by an up-and-down moving mechanism 505; a discharging roller pair 507 which discharges copying paper forwarded from the copying-paper receiver 503 onto the sorting outlet tray 506; an outlet tray 508 used for non-sorting which is disposed on one side of the upper part of the after-processing section 500; a forwarding branching guide 509 which switches the direction in which the copying paper coming out of the carrying-in roller pair 502 is forwarded from the side of the copying-paper receiver 503 to the side of the non-sorting outlet tray 508, and vice versa; and a discharging roller pair 510 which discharges copying paper onto the non-sorting outlet tray 508.

The after-processing section 500 is provided with receiver carrying-in rollers 511, 512, 513 which carry copying paper into the copying-paper receiver 503, and movable guiding members 514, 515, 516 and a static guiding portion 517 which guide copying paper into the copying-paper receiver 503. The rollers 511, 512, 513 are each put in different positions at predetermined intervals in the direction where copying paper is carried in, and so are the guiding members 514, 515, 516 and the guiding portion 517. Thereby, the position in which copying paper is carried into the copying-paper receiver 503 can be changed according to copying-paper sizes and how copying paper is placed, lengthwise or breadthwise. In other words, the above configuration can cope with copying-paper sheets which are of various sizes and have different lengths in the direction where they are forwarded. Then, copying-paper sheets are carried into the copying-paper receiver 503 after their edges are trued up, where stapling processing can be conducted in the stapling processing portion 504.

The copying-paper receiver 503 includes a receiving member (not shown) which receives and holds the lower edge of copying paper carried into the copying-paper receiver 503, and a driving portion (not shown) which moves the receiving member in the direction where the copying paper is carried out. The driving portion is driven according to control signals from the controlling section 2, thereby forwarding the copying paper held in the receiving member up to the discharging roller pair 507. Then, the discharging roller pair 507 discharges the copying paper onto the sorting outlet tray 506.

Figure 15:
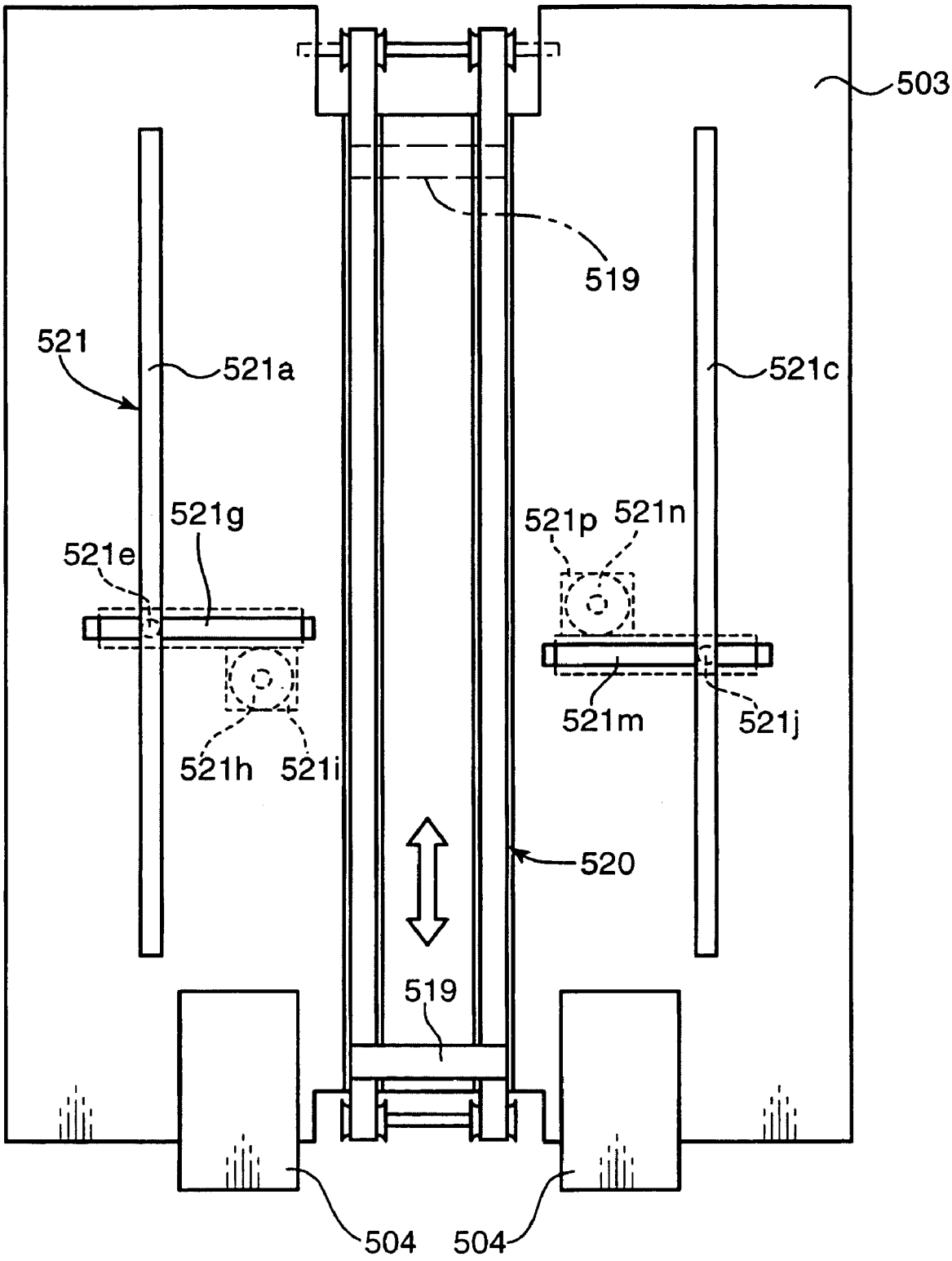
FIG. 15 is a diagram showing a sideway moving mechanism in its plan view.

On the back-surface side of the copying-paper receiver 503, a copying-paper sideway-moving mechanism 521 is provided which can move the sideway-moving plates 521*a*, 521*c* widthwise along the front surface of the copying-paper receiver 503. As shown in FIG. 15, the copying-paper receiver 503 is provided with a pair of sideway-moving plates 521*a*, 521*c* which are apart widthwise from each other; a bottom stopper 519 adapted for making contact with the bottom end of the copied paper stacked on the copying-paper receiver 503; and a transport mechanism having a transfer belt 520 driven by a motor (not shown) for driving the stacked copied paper forward and discharging the same from the copying-paper receiver 503 onto the outlet tray 506. The sideway-moving mechanism 521 has a left side moving unit provided for contacting with the left-hand side of the copied paper and a right side moving unit provided for contacting with the right-hand side of the copied paper stacked on the copying-paper receiver 503. The left side moving unit includes a left-side moving plate 521*a*, having a support portion 521*e* which is fixed on a rack 521*g* meshed with a pinion gear 521*h* driven by an actuator (a motor) 521*i*. The actuator 521*i* is rotatable in both c.c.w. (counterclockwise) and c.w. (clockwise) directions upon receiving a drive signal from the controlling section 2. When the actuator 521*i* is driven to rotate the pinion gear 521*h* in c.w. direction, the rack 521*g*, being meshed with the pinion gear 521*h*, is driven to move rightward direction, thereby moving the left-side plate 521*a* rightward direction. The right side moving unit includes a right-side moving plate 521*c*, having a support portion 521*j* which is fixed on a rack 521*m* meshed with a pinion gear 521*n* driven by an actuator (a motor) 521*p*. The actuator 521*p* is rotatable in both c.c.w. and c.w. directions upon receiving a drive signal from the controlling section 2. When the actuator 521*p* is driven to rotate the pinion gear 521*n* in c.w. direction, the rack 521*m*, being meshed with the pinion gear 521*n*, is driven to move rightward direction, thereby moving the right-side plate 521*c* rightward direction. Japanese Patent Laid-Open No. 13-150766 discloses, in figures (i.e., FIG. 3), one of typical types of such mechanism. However, the copying-paper sideway-moving mechanism according to the present invention is not necessarily limited to this kind of mechanism which is configured by a rack, a pinion, a motor and other members) The sideway-moving plates 521*a*, 521*c* guide sheaves of copying paper carried into the copying-paper receiver 503, enabling each sheaf to move widthwise along the surface of the copying-paper receiver 503. Thereby, each of the sheaves which have been moved widthwise can be discharged onto the sorting outlet tray 506. This allows each copying-paper sheaf to be discharged, from its own discharging position, onto the sorting outlet tray 506.

The up-and-down moving mechanism 505 moves the sorting outlet tray 506, up and down, according to control signals from the controlling section 2, so that the upper surface of a copying-paper sheaf to be discharged onto the sorting outlet tray 506 can be brought to a basic position in which the copying-paper sheaf will be fitly discharged from the discharging roller pair 507.

Figure 2:
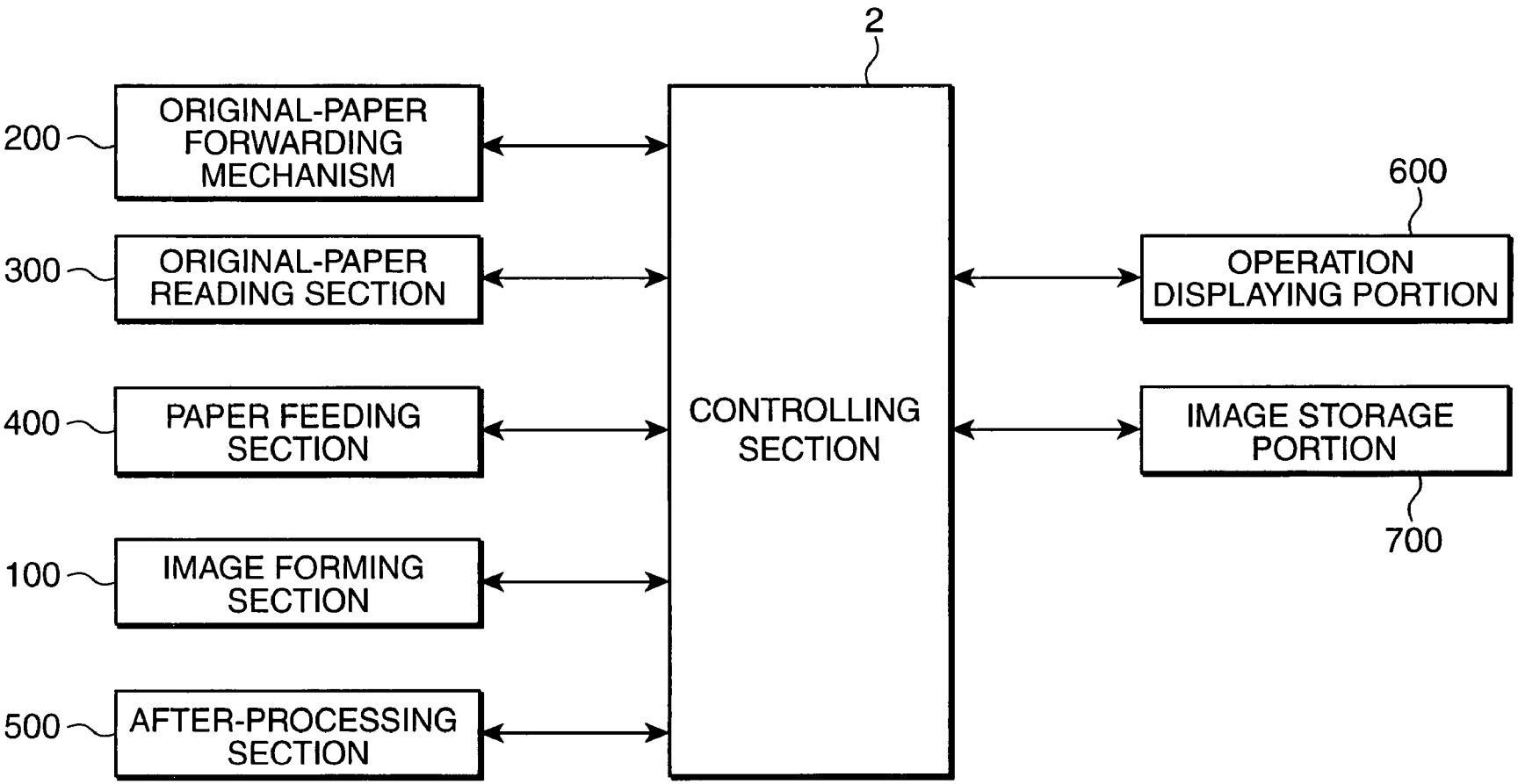
FIG. 2 is a block diagram of the image forming apparatus according to the embodiment of the present invention.

FIG. 2 is a block diagram of the image forming apparatus. In FIG. 2, the image forming apparatus comprises: as blocks, the image forming section 100; the original-paper forwarding mechanism 200; the original-paper reading section 300; the paper feeding section 400; the after-processing section 500; an operation displaying portion 600 which functions as various kinds of input key switches and the like; and an image storage portion 700. The image forming apparatus further comprises the controlling section 2 which outputs control signals according to input signals from the operation displaying portion 600 and controls operations of the blocks mentioned above by outputting the control signals to each block.

Figure 3:
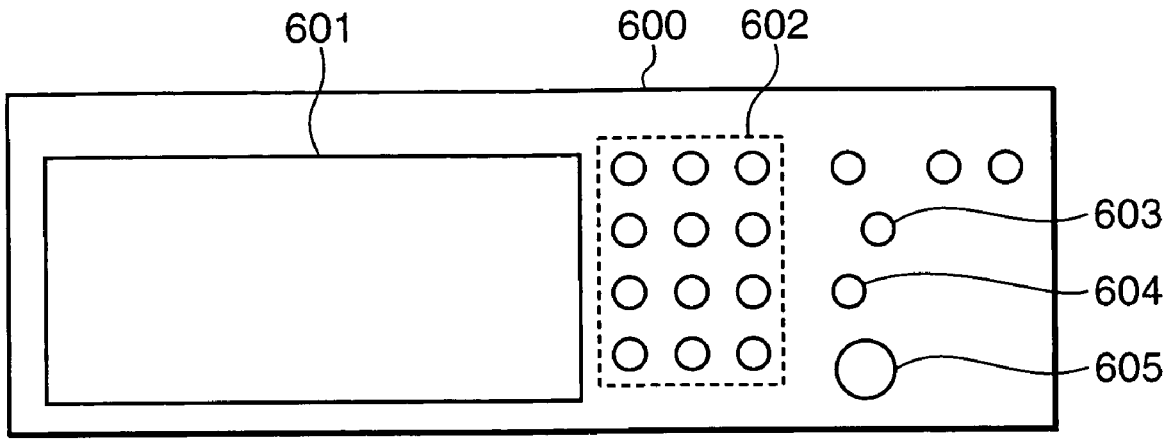
FIG. 3 is a schematic view of an example of an operation displaying portion 600 according to the embodiment of the present invention.

FIG. 3 is a schematic view of an example of the operation displaying portion 600. The operation displaying portion 600 includes: a touch panel 601 which is configured, for example, by a liquid-crystal display panel and a transparent pressure sensor disposed on the surface of the display panel; a ten key 602 which inputs numerical values such as the number of copies (or the number of sets); a reset key 603 which inputs instructions to initialize set information; a stop/clear key 604 which stops copying operations, and using the ten key 602, erases inputted numerical values; and a start key 605 which inputs instructions to start copying operations.

FIG. 4 is an illustration showing an example of a screen to be displayed on the touch panel 601. A set display 606 is a display portion which displays the number of copies (or the number of sets) inputted using the ten key 602.

Figure 4A:
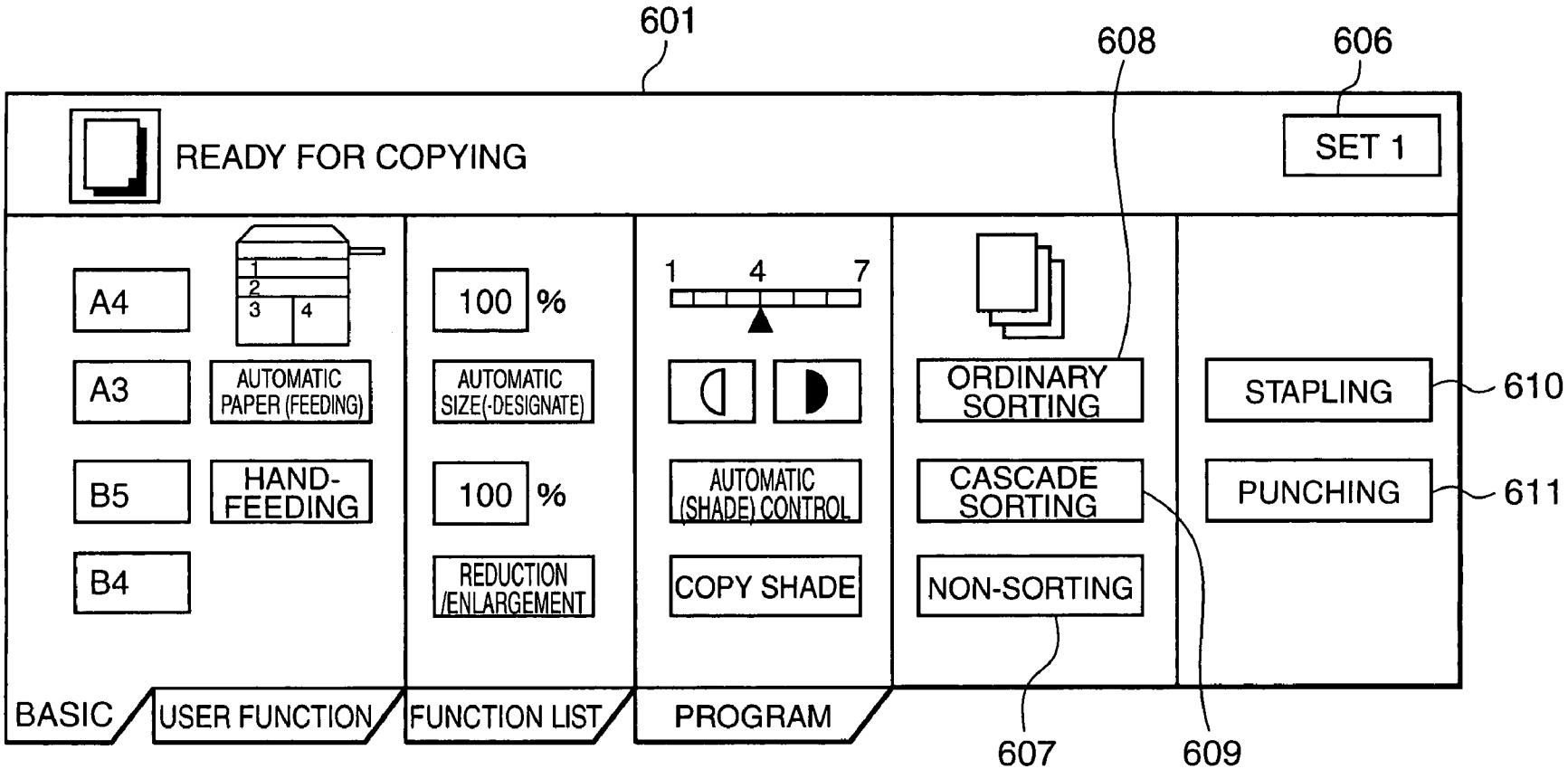
FIG. 4 is an illustration showing an example of an operation screen according to the embodiment of the present invention.
Figure 4B:
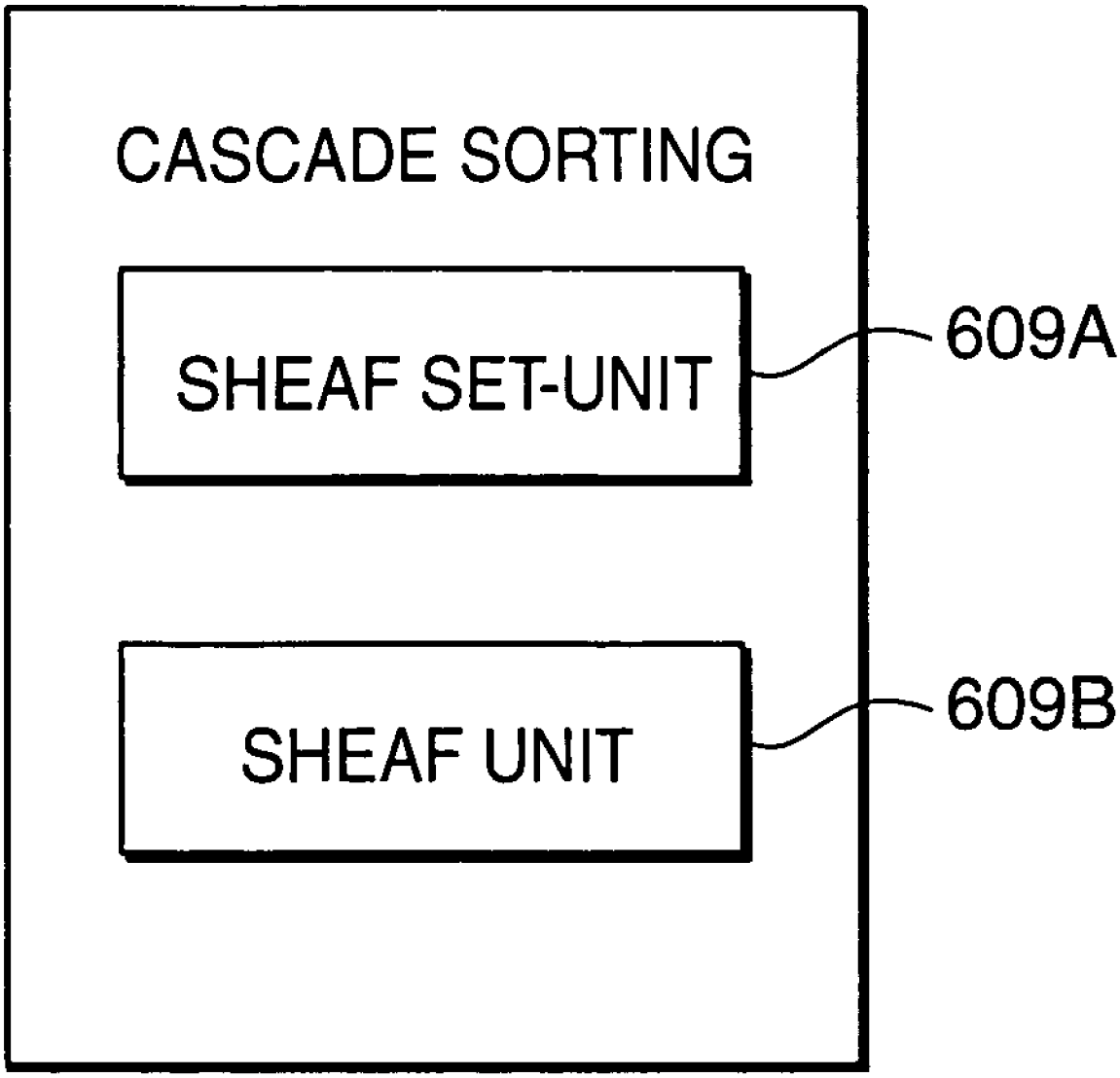
Figure 12:
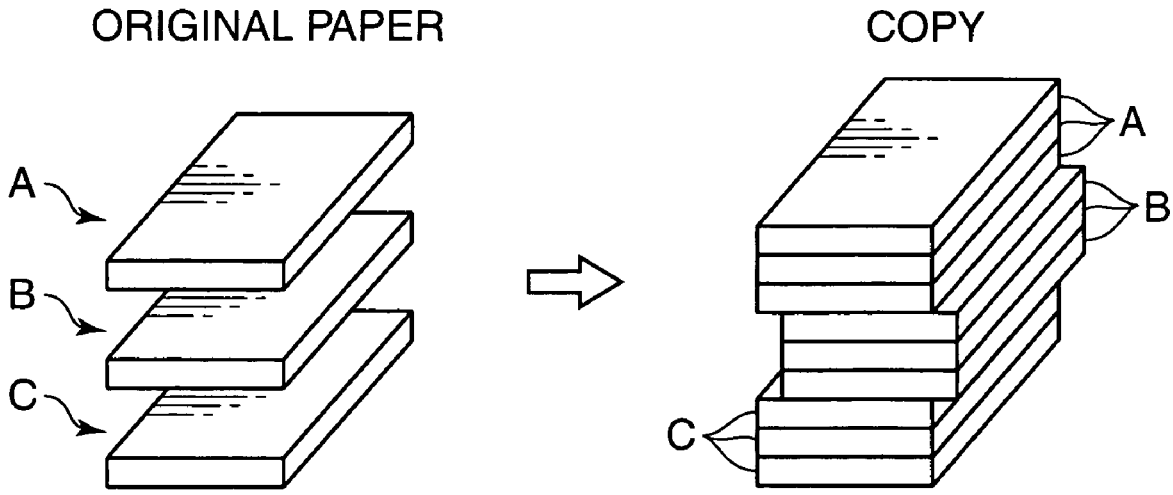
FIG. 12 is an illustration showing the state of copies outputted in an ordinary sorting mode.
Figure 13:
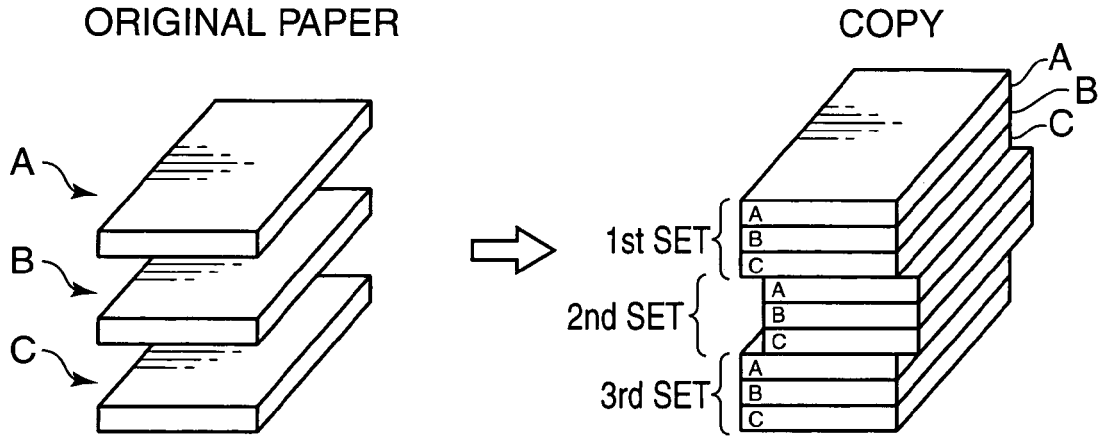
FIG. 13 is an illustration showing the state of copies outputted in a sheaf-set-unit sorting mode.

A non-sorting key 607 is a key which sets an ordinary mode in which copying paper on which an image is formed is not sorted and is discharged to the non-sorting outlet tray 508. On the other hand, an ordinary sorting key 608 is a key which sets an ordinary sorting mode in which sheets of image-formed copying paper are arranged in the same page order as that of the original paper, the required number of copies (or sets) are made in each sheaf, and these sets of sheaves are discharged to the sorting outlet tray 506(see FIG. 12). In addition, a cascade sorting key 609 is a key which sets a cascade sorting mode (or sheaf set-unit sorting) in which images of a set of original paper made up of a plurality of sheaves of original paper are read, the sheaves of copying paper on which those images have been formed in the same order as that of the original paper are designated as one set, and the required number of sets are discharged to the sorting outlet tray 506 (see FIG. 13). As described above, if the cascade sorting key 609 is pushed, the single cascade sorting mode is set. Alternatively, however, if the cascade sorting key 609 is pushed, as shown in FIG. 4B, a sub-screen may also be displayed which is used to choose a mode of cascade sorting between sheaf set-unit sorting by means of a key 609A and sheaf-unit sorting by means of a key 609B.

A stapling key 610 is a key which inputs instructions to conduct, as finishing processing, stapling processing of each sheaf of image-formed copying paper. A punching key 611 is a key which inputs instructions to conduct, as finishing processing, punching processing of image-formed copying paper. Herein, stapling processing may, or may not, be conducted of each set of sheaves, or of each sheaf making up a set. In other words, the user can choose whether to conduct such processing in a sheaf set-unit, or whether to conduct it in a sheaf unit. This is also applied to punching processing.

In the above described FIG. 2, the controlling section 2 is configured by a ROM (or read only memory) storing a control program of the image forming apparatus, a microcomputer housing a RAM (or random access memory) which stores data temporarily and the like. When the start key 605 is pushed, the controlling section 2 is designed to output a control signal to start a copying operation to each block of the image forming section 100, the original-paper forwarding mechanism 200, the original-paper reading section 300, the paper feeding section 400, the after-processing section 500, and the image storage portion 700.

If the start key 605 is pushed in the ordinary mode mentioned above, the controlling section 2, first of all, allows the image storage portion 700, which is configured by the RAM and the like, to store each page of image data obtained in the original-paper reading section 300. Then, the controlling section 2 executes control of an operation in which copying of the first page of the image data is conducted for the number of copies (or the number of sets). Next, it executes control of an operation in which copying of the second page of the image data is conducted for the number of copies (or the number of sets). Such operations are repeated for each page of the image data stored in the image storage portion 700. Then, sheaves of copying paper on which images of the original paper have been copied in the ordinary mode are discharged to the non-sorting outlet tray 508.

If the start key 605 is pushed in the ordinary sorting mode mentioned above, the controlling section 2, first of all, allows the image storage portion 700 to store each page of image data obtained in the original-paper reading section 300. Then, the controlling section 2 executes control of an operation in which copying of the image data is conducted in page order from the first page to the last page. This operation is repeated for the number of copies (or the number of sets).

As a result, sheets of copying paper on which images of the original paper have been copied are arranged in the same page order as the original-paper sheets. Then, the position in which the copying paper is discharged is shifted for each of the copies (or sets) which correspond to the original-paper sheaves. Thereby, each copy is discharged in sheaves to the sorting outlet tray 506. In this case, the controlling section 2 conducts finishing processing, such as stapling processing, punching processing or discharging-position shifting processing, of sheaves of each copy, before these sheaves are discharged with being identifiable in each copy-unit.

If the start key 605 is pushed in the cascade sorting mode mentioned above, the controlling section 2, first of all, allows the image storage portion 700 to store each page of image data of the first original-paper sheaves obtained in the original-paper reading section 300. Herein, the image data is made identifiable in a unit of the original-paper sheaves as the first image data. Then, image data of the following original-paper sheaves is made identifiable in a unit of the original-paper sheaves as the second image data. Thus, each page of the image data is stored in the image storage portion 700. This is repeated for the whole original-paper sheaves.

First, the controlling section 2 executes control of an operation in which copying of the first image data is conducted in page order from the first page to the last page. Next, in the same way, it executes control of an operation in which copying of the second image data is conducted in page order from the first page to the last page. This copying operation is repeated for image data of the whole original-paper sheaves. In this case, the controlling section 2 conducts finishing processing, such as stapling processing, punching processing or discharging-position shifting processing, of each copy of copying-paper sheaves which correspond to the original-paper sheaves. Then, these sheaves are discharged with being identifiable in each copy-unit. In a practical manner, punching processing is not conducted of each copying-paper sheaf, but it is conducted of each sheet, one by one, before being cast into a copying-paper receiver. Such punching processing, which is conducted in a sheet unit while being forwarded, allows the whole copying process to be swiftly conducted and thereby to be completed in almost the same time as a copying process without punching processing. In addition, there is no need to provide any such exclusive copying-paper receiver as required in a stapler. As a result, a plurality of copying-paper sheets on which images of a set of original paper made up of a plurality of sheaves of original paper are copied are discharged as one set to the sorting outlet tray 506, after the copying-paper sheets are arranged in the same order as the original paper and are made in each sheaf so as to correspond to each original-paper sheaf. In the cascade sorting mode, this set is designed to be one unit.

Sequentially, the controlling section 2 repeats the copying operation in which the plurality of copying-paper sheets are obtained as one set, by the number of copies (or the number of sets). This allows the required copies (or sets) of copying-paper sheets to be discharged to the sorting outlet tray 506.

Herein, the image forming apparatus according to the present invention may also be, for example, an image forming apparatus such as a printer which forms images by receiving digital image data of original-paper images from an outside apparatus such as a personal computer. Such an apparatus not necessarily needs the original-paper reading section 300. Furthermore, another image forming apparatus such as a facsimile may also be used, in which an output method such as the cascade sorting mode may also be instructed when fax image data stored in a memory is outputted.

Figure 5:
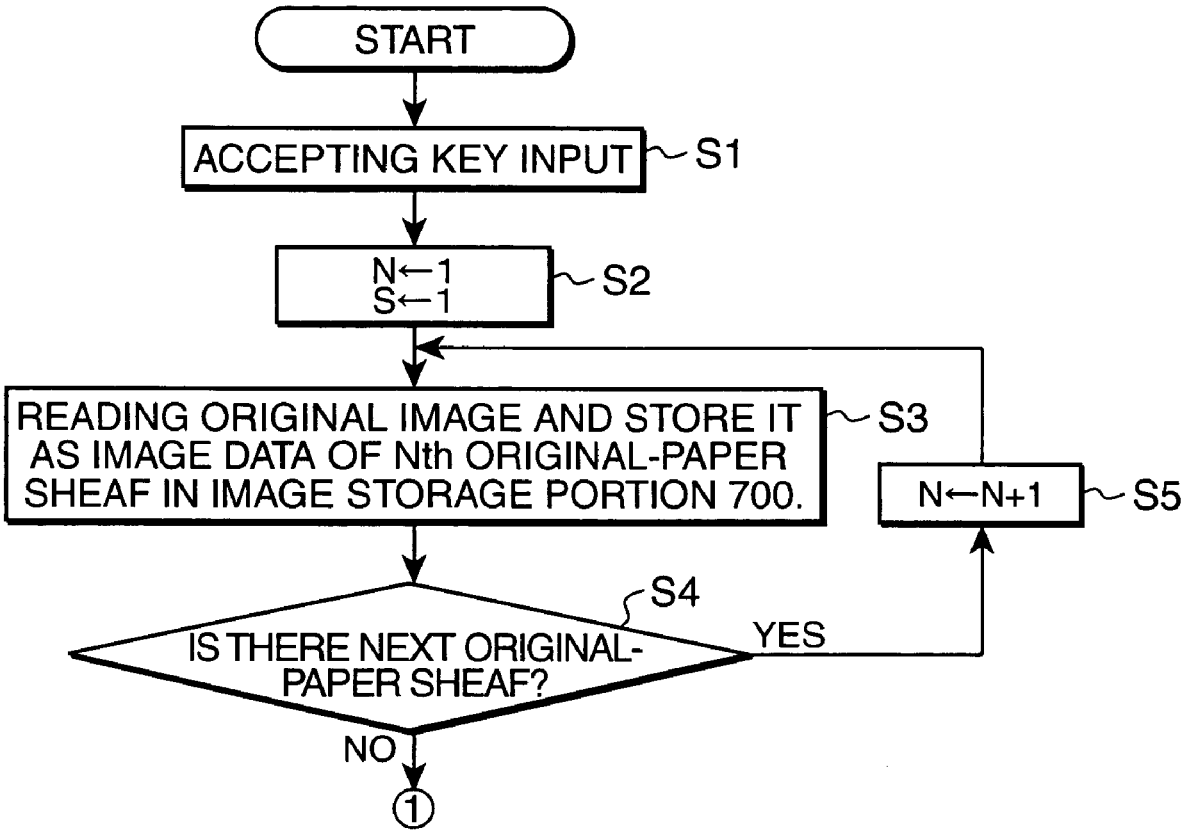
FIG. 5 is a flow chart showing an operation of the image forming apparatus according to the embodiment of the present invention.
Figure 6:
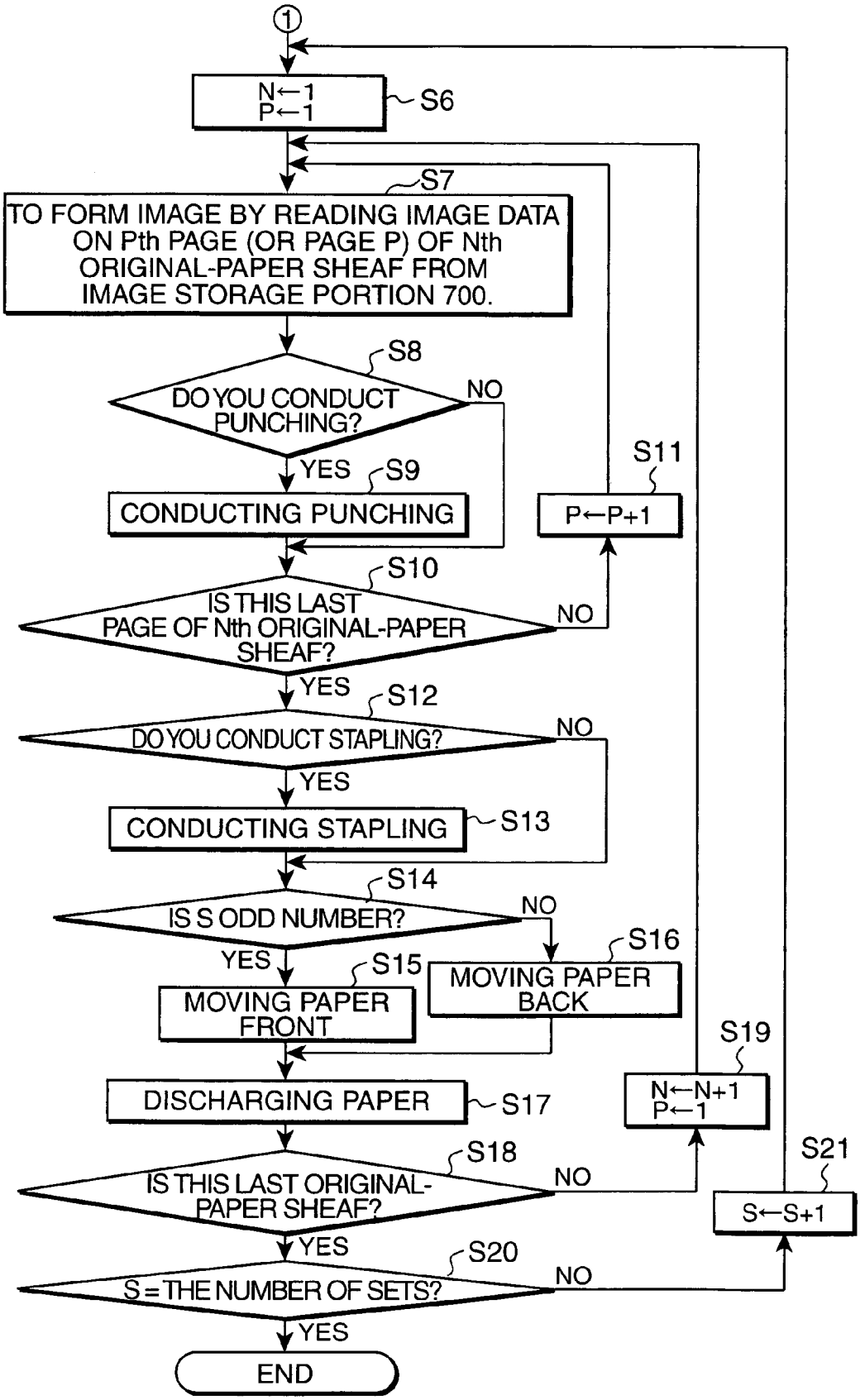
FIG. 6 is a flow chart showing an operation of the image forming apparatus according to the embodiment of the present invention.

FIG. 5 and FIG. 6 are flow charts showing an operation of the image forming apparatus shown in FIG. 2. For example, an operation screen shown in FIG. 4A is first displayed on the operation displaying portion 600. If the cascade sorting key 609 is pushed to designate the cascade sorting mode, a numerical value inputted by means of the ten key 602 is designated as the number of copies (or the number of sets). If the stapling key 610 is pushed, stapling processing is designated. If the punching key 611 is pushed, punching processing is designated (a step S1).

Next, if the start key 605 is pushed, a copying operation in the cascade sorting mode is started to execute initialization by substituting one for a variable N which shows the number of original-paper sheaves and a variable S which is used to count the number of copies (or the number of sets), respectively (a step S2).

Then, the controlling section 2 executes control, by means of its control signal, of the operation of the original-paper forwarding mechanism 200. Each sheet of original paper placed on the original-paper placement portion 201 is forwarded one by one so as to come into contact with the contact glass 302, and then, is discharged onto the discharged-paper receiver 205. When the original paper has come into contact with the contact glass 302, its image data is obtained by the original-paper reading section 300. The image data is outputted to the controlling section 2 and is stored, as the image data of the Nth original-paper sheaf, page by page in the image storage portion 700 (a step S3).

Figure 7:
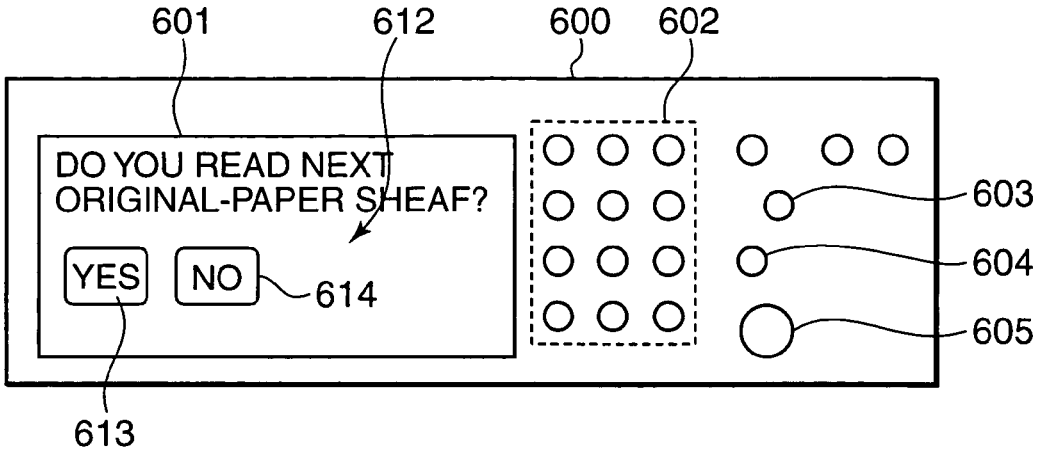
FIG. 7 is an illustration showing another example of the operation screen according to the embodiment of the present invention.
Figure 8:
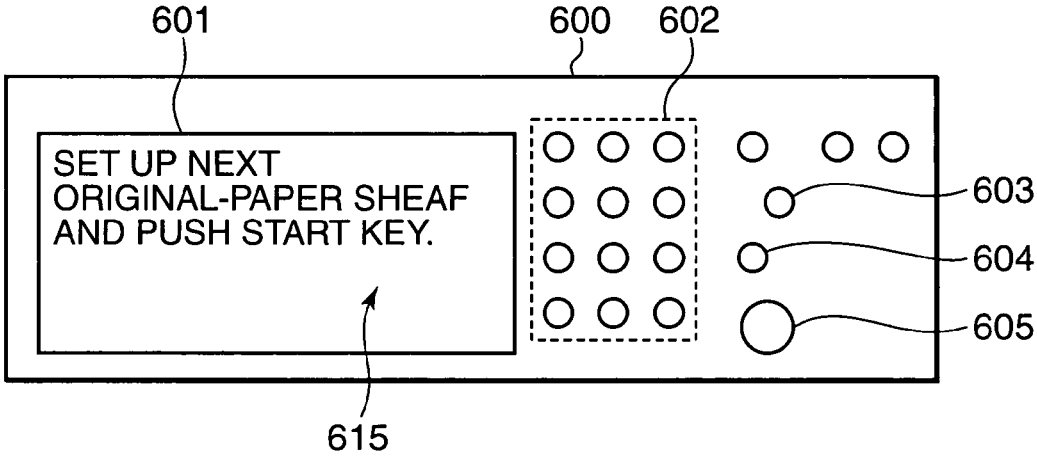
FIG. 8 is an illustration showing an example of an operation guide screen according to the embodiment of the present invention.

Next, if the original-paper detecting switch 206 detects none of the original paper being placed on the original-paper placement portion 201, the controlling section 2 judges that reading has been completed of the image data of the $N_{th}$ original-paper sheaf. Then, it allows the operation displaying portion 600 to display, for example, a screen 612 shown in FIG. 7, which is used for confirming reading of the following original-paper sheaf. If an input key 613, which shows there is the following original paper, is pushed (or if YES in a step S4), then, for example, a guide screen 615 shown in FIG. 8 is displayed on the operation displaying portion 600. This prompts a user to place the following original paper on the original-paper placement portion 201. When detecting the start key 605 have been pushed, the controlling section 2 adds one to the variable N (a step S5). Then, a shift is made to the step S3 in which reading is executed of images of the following original-paper sheaf.

Figure 9:
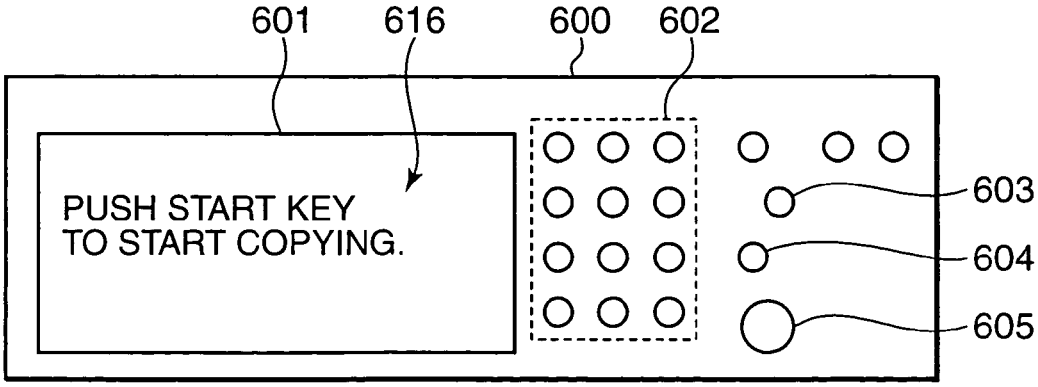
FIG. 9 is an illustration showing another example of the operation guide screen according to the embodiment of the present invention.

On the other hand, if an input key 614, which shows there is not the following original paper, is pushed (or if NO in the step S4), then, for example, a guide screen 616 shown in FIG. 9 is displayed on the operation displaying portion 600. This notifies the user that reading of all the original-paper images has been completed and a shift will be made to an image forming operation. If the start key 605 is detected have been pushed, a shift is made to a step S6 in which the image forming operation is conducted.

Next, in order to conduct the image forming operation, as shown in FIG. 6, the controlling section 2 executes initialization by substituting one for the variable N and a variable P which shows page numbers of original-paper sheets, respectively (the step S6). Then, the controlling section 2 executes control, by means of its control signal, of the operation of the image forming section 100 and the paper feeding section 400. And the controlling section 2 outputs image data on the $P_{th}$ page of the $N_{th}$ original-paper sheaf which has read out of the image storage portion 700, to the image forming section 100. Then, the image forming section 100 copies an image formed from the image data, for example, onto copying paper which has been picked up and forwarded from the paper feeding cassette 401 (a step S7).

Next, the controlling section 2 switches the discharge branching guide 111 to the side of the discharging roller pair 110. Then, the discharging roller pair 110 discharges the copying paper on which the image data has been copied in the image forming section 100, to the after-processing section 500. If punching processing is designated (or if YES in a step S8), the controlling section 2 executes, by means of its control signal, the operation of the punching portion 501 (a step S9). Then, the copying paper carried into the after-processing section 500 is carried into the copying-paper receiver 503, after its punching processing has been conducted. If punching processing is not designated (or if NO in the step S8), the copying paper carried into the after-processing section 500 is carried, without receiving punching processing, into the copying-paper receiver 503.

Next, the controlling section 2 confirms whether or not an image on the last page of the $N_{th}$ original-paper sheaf has been copied, in other words, whether or not processing has been completed of forming, onto copying paper, images from all image data of the $N_{th}$ original-paper sheaf stored in the image storage portion 700. If it is not completed (or if NO in a step S10), one is added to the variable P (a step S11) and a shift is made again to the step S7, so that processing will be conducted of image data on the following page of the $N_{th}$ original-paper sheaf.

Through the processing in the aforementioned steps S6 to S11, images of image data on all pages of the $N_{th}$ original-paper sheaf onto copying-paper sheaf, which is carried into the copying-paper receiver 503.

On the other hand, if processing has been completed of forming, onto copying paper, images from all image data of the $N_{th}$ original-paper sheaf (or if YES in the step S10), the controlling section 2 confirms whether stapling processing is designated or not. If stapling processing is designated (or if YES in a step S12), the controlling section 2 executes, by means of its control signal, the operation of the stapling processing portion 504. In this operation, stapling processing is conducted of a copying-paper sheaf stocked in the copying-paper receiver 503 (a step S13), and then, a shift is made to a step S14. If stapling processing is not designated (or if NO in the step S12), a shift is made to the step S14, without punching processing.

Next, the controlling section 2 confirms whether the variable S is an odd number or not. If the variable S is an odd number (or if YES in the step S14), the sideway-moving plates 521*a*, 521*c* are moved in the front direction (with respect to a user's standing location) of the image forming apparatus shown in FIG. 1. Then, a copying-paper sheaf stocked in the copying-paper receiver 503 is guided by the sideway-moving plates 521*a*, 521*c*, and thus, is moved in the front direction. In other words, the left-side moving plate 521*a* and the right-side moving plate 521*c* are driven to move in a rightward direction in FIG. 15 so that the copying-paper sheaf stocked in the copying-paper receiver 503 is moved in the rightward direction in FIG. 15 (a step S15). If the variable S is an even number (or if NO in the step S14), the sideway-moving plates 521*a*, 521*c* are moved in the back direction (opposite from the direction where the user stands) of the image forming apparatus shown in FIG. 1. Then, a copying-paper sheaf stocked in the copying-paper receiver 503 is guided by the sideway-moving plates 521*a*, 521*c*, and thus, is moved in the back direction. In other words, the left-side moving plate 521*a* and the right-side moving plate 521*c* are driven to move in a leftward direction in FIG. 15 so that the copying-paper sheaf stocked in the copying-paper receiver 503 is moved in the leftward direction in FIG. 15 (a step S16).

Next, the controlling section 2 executes control, by means of its control signal, of the operation of the driving portion which moves the receiving member. In this operation, a copying-paper sheaf held in the receiving member is forwarded from the copying-paper receiver 503 up to the discharging roller pair 507. Then, the copying-paper sheaf is discharged, by the discharging roller pair 507, onto the sorting outlet tray 506 (a step S17). As a result, according to the numerical value of the variable S, in other words, whether it is an odd number or an even number, a shift is made of the position in which the copying-paper sheaf is discharged. Specifically, if the variable S is an odd number, or if the copying-paper sheaf belongs among odd-number sets in order of the number of copies, its discharging position is shifted to the front direction. On the other hand, if the variable S is an even number, or if the copying-paper sheaf belongs among even-number sets, its discharging position is shifted to the back direction. Thereby, a plurality of copying-paper sheaves whose finishing processing such as stapling processing is conducted are discharged, in a set-unit and in the same position, onto the sorting outlet tray 506. This makes those sheaves one set. In addition, each set of the plurality of copying-paper sheaves are discharged, in alternate positions, onto the sorting outlet tray 506. This allows each set to be identifiable (see FIG. 13).

Figure 14:
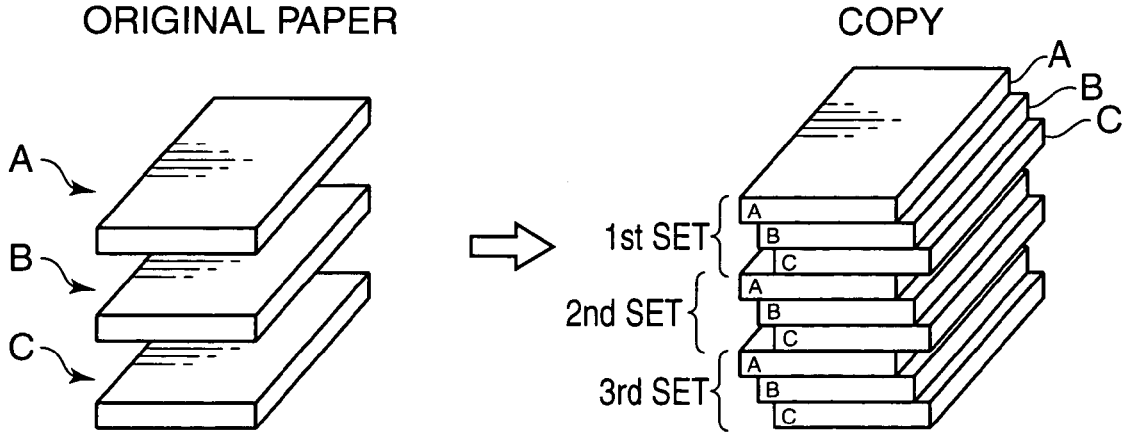
FIG. 14 is an illustration showing the state of copies outputted in a sheaf-unit sorting mode.

Hereinbefore, an example is shown in which a shift is made of the position in which each set of copying-paper sheaves is discharged to the sorting outlet tray 506. However, the discharging position may also be shifted sheaf by sheaf, which makes it possible to identify the copying-paper sheaves As described previously, in the sub-screen (see FIG. 4B) displayed when the cascade sorting key 609 (see FIG. 4A) has been pushed, the sheaf-unit sorting key 609B is pushed. Thereby, when one and the same set of copying-paper sheaves is stocked in the copying-paper receiver 503, the sideway-moving mechanism may also move the sideway-moving plates 521*a*, 521*c* for each copying-paper sheaf, in sequence, little by little in the same direction. Thereby, the discharging position of each copying-paper sheaf is shifted, in sequence, little by little in the same direction, allowing the user to identify each copying-paper sheaf. Then, just before the first copying-paper sheaf of each set (or a copying-paper sheaf which corresponds to N=1 after one is added to S) is discharged onto the sorting outlet tray 506, the sideway-moving plates 521*a*, 521*c* is moved back to its initial position. Thereby, the position in which the first copying-paper sheaf of each set is discharged becomes the same, allowing the user to identify each set of copying-paper sheaves (see FIG. 14).

Next, the controlling section 2 confirms whether or not images of the last original-paper sheaf have been copied, in other words, whether or not processing has been completed of forming, onto copying paper, images from image data of all the original-paper sheaves which is stored in the image storage portion 700. If it has not been completed (or if NO in a step S18), one is added to the variable N, so that processing will be conducted of image data of the following original-paper sheaf. And one is substituted for the variable P, so that processing will be conducted of image data of the following original-paper sheaf, from its first page (a step S19). Then, a shift is made again to the step S7.

Through the processing in the aforementioned steps S6 to S19, images of image data of all the original-paper sheaves are copied onto a set of copying-paper sheaves, and then, these copying-paper sheaves, as one set, are discharged onto the sorting outlet tray 506.

Next, the controlling section 2 confirms the value of the variable S. If the variable S is not equal to the number of copies (or the number of sets) (or if NO in a step S20), one is added to the variable S, so that the following set of images will be formed (a step S21). Then, a shift is made again to the step S6. If the variable S is equal to the number of copies (or the number of sets) (or if YES in the step S20), that means that the whole processing has been completed, specifically, that copying-paper sheaves are already discharged onto the sorting outlet tray 506, after being grouped into the designated number of copies (or the designated number of sets).

Figure 10:
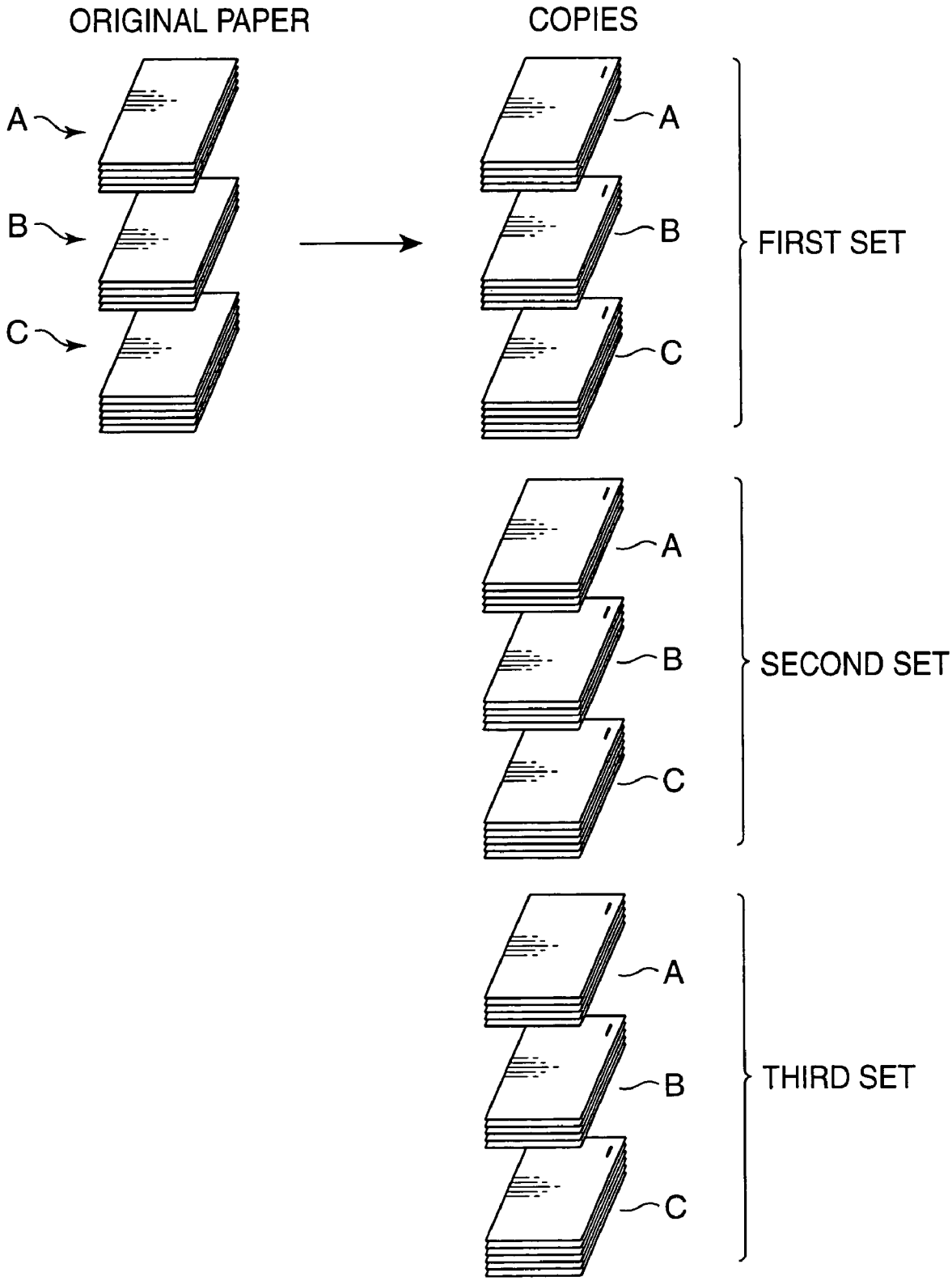
FIG. 10 is an illustration showing the state of copies outputted by the image forming apparatus according to the embodiment of the present invention.
Figure 11:
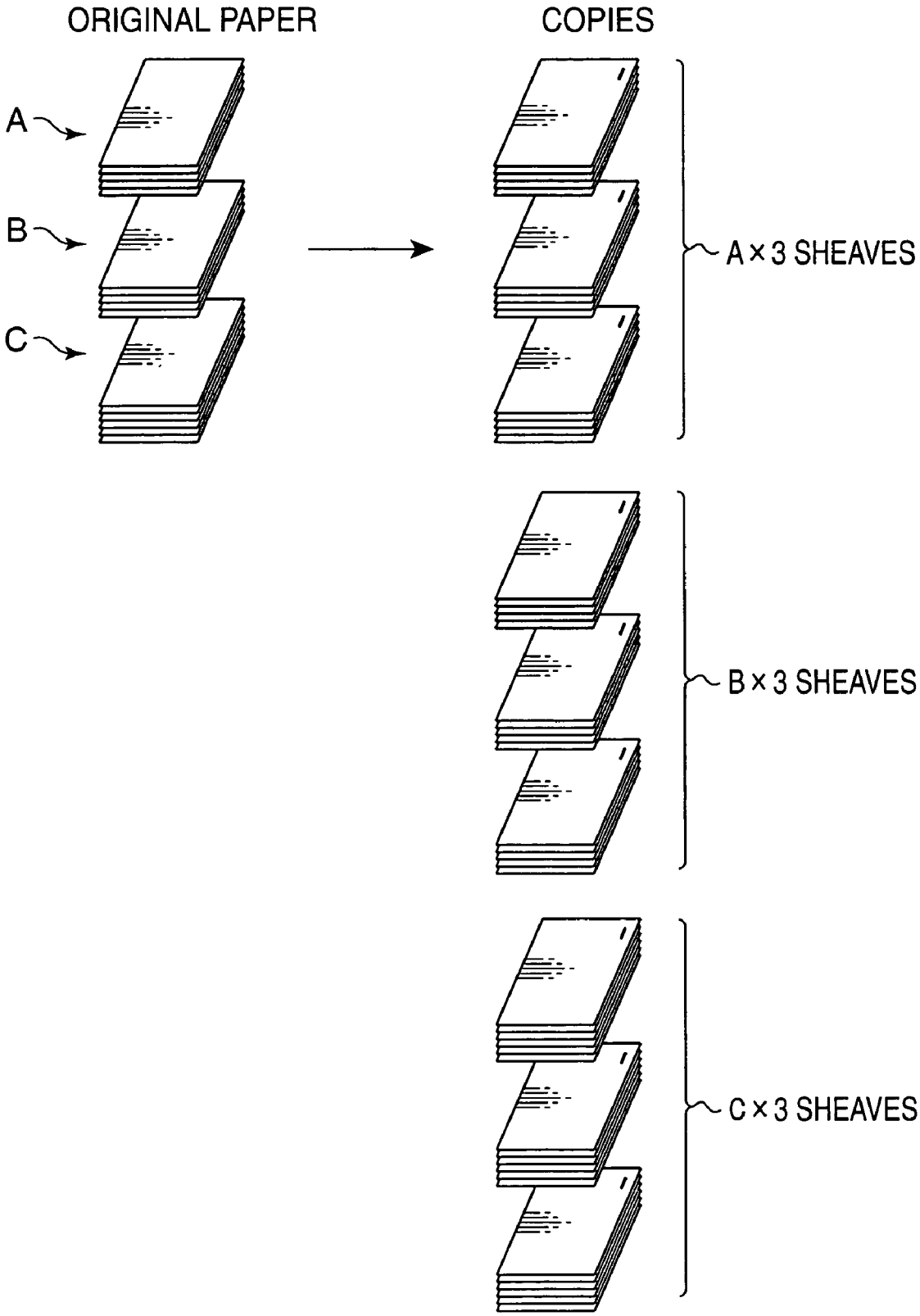
FIG. 11 is an illustration showing the state of copies outputted by a conventional image forming apparatus.

FIG. 10 is an illustration showing copies which are obtained in the case where a copying operation is executed, for example, for three original-paper sheaves A, B, C. Specifically, this is an example in which stapling processing is conducted in the cascade sorting mode, through the processing in the aforementioned steps S1 to S21. In this case, images of the original-paper sheaves A, B, C are each copied, the stapled sheaves of copies A, B, C are arranged as one set, and three sets of those copies are obtained.

Herein, the after-processing section 500 discharges designated sets of copying-paper sheaves onto the single sorting outlet tray 506, by shifting the position in which each set is discharged to group these sets. However, the after-processing section 500 may also include a plurality of outlet bins. In such a case, the after-processing section 500 switches those outlet bins for each set of copying-paper sheaves to discharge a set of copying-paper sheaves onto each outlet bin. Such an after-processing section 500 not necessarily needs the sideway-moving plates 521 and the sideway-moving mechanism.

Herein, in the cascade sorting mode, image forming processing is started after image data of all original-paper sheaves has been stored in the image storage portion 700. However, before image data of all original-paper sheaves is obtained, processing may also be started of forming images of the first set of the sheaves. In other words, image forming processing of the first set may also be conducted in parallel with image-data obtaining processing.

As described above, according to the image forming apparatus of the present invention, a data fetching means fetches a plurality of pages of first image data and a plurality of pages of second image data; an operation section accepts the number of sets by which the first and second image data is each copied and an instruction to sort copying-paper sheets in each sheaf; an image forming section copies each of the first and second image data, page by page, onto copying paper; an operation in which the first sheaf of copying-paper sheets on which the first image data has been copied and the second sheaf of copying-paper sheets on which the second image data has been copied are guided, in sequence, to an outlet portion so that they are piled in this order, is executed for the predetermined number of sets. Herein, the data fetching means either may optically read images on sheets of original paper which is placed on an original-paper holder, or may receive image data of those images from an outside memory.

In short, the operation in which the first and second copying-paper sheaves are guided, in sequence, to the outlet portion so that they are piled in this order, is executed for the predetermined number of sets. As a result, images of a set of original paper made up of a plurality of original-paper sheaves can be copied onto copying paper, in the same order as the original paper, and then, the plurality of copying-paper sheaves can be outputted as one set.

Furthermore, according to this image forming apparatus, first, the first image data is copied to the first copying-paper sheaf, and sequentially, the second image data is copied to the second copying-paper sheaf. This copying operation is repeated for the predetermined number of sets. After the copying, the copying paper is discharged to a single outlet tray. Thereby, as the above described outlet portion, a plurality of outlet portions need no providing.

Furthermore, according to this image forming apparatus, an after-processing section is provided to conduct finishing processing of the first sheaf of copying-paper sheets on which the first image data has been copied and the second sheaf of copying-paper sheets on which the second image data has been copied, individually.

Furthermore, according to this image forming apparatus, each of the first copying-paper sheaf and the second copying-paper sheaf is stapled separately, so that each copying-paper sheaf can be identified.

Furthermore, according to this image forming apparatus, each of the first copying-paper sheaf to which the first image data has been copied and the second copying-paper sheaf to which the second image data has been copied, is punched separately, so that each copying-paper sheaf can be easily filed.

This application is based on Japanese patent application serial no. 2002-299465, filed in Japan Patent Office on Oct. 11, 2002, the contents of which are hereby incorporated by reference.

Although the present invention has been fully described by way of example with reference to the accompanied drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image forming section for copying image data of each page onto copying paper;

a discharger for discharging the copying paper after the copying, and guiding the copying paper to an outlet portion;

an operation section in which an instruction related to image forming is inputted by a user;

a controlling section for operating said image forming section based on the image forming instruction from said operation section; and a data fetching means for fetching first image data which corresponds to a first sheaf of original paper to be copied and second image data which corresponds to a second sheaf of original paper to be copied, wherein: said operation section accepts, as the image forming instruction, a sorting instruction which includes a predetermined number of copies of each of the first image data and second image data and sorting of the copies; and said controlling section, based on the sorting instruction from said operation section, executes, for the predetermined number of copies, an operation of guiding the first sheaf of copying paper and the second sheaf of copying paper, in sequence, to said outlet portion so that the first sheaf of copying paper and the second sheaf of copying paper are piled in this order.

2. The image forming apparatus according to claim 1, wherein: said outlet portion is configured by an outlet tray; and said controlling section executes an operation of copying the first image data onto the first sheaf of copying paper, and subsequently, executes an operation of copying the second image data onto the second sheaf of copying paper, and the operations are repeated for the predetermined number of copies.

3. The image forming apparatus according to claim 1, further comprising an after-processing section for conducting finishing processing of copying paper, wherein said controlling section operates said after-processing section to conduct finishing processing of each of a first sheaf of copying paper on which the first image data is copied and a second sheaf of copying paper on which the second image data is copied.

4. The image forming apparatus according to claim 3, wherein the finishing processing is stapling processing.

5. The image forming apparatus according to claim 4, wherein an instruction to conduct, or not to conduct, the stapling processing of each sheaf of copying paper, is inputted in said operation section.

6. The image forming apparatus according to claim 3, wherein the finishing processing is punching processing.

7. The image forming apparatus according to claim 6, wherein an instruction to conduct, or not to conduct, the punching processing of each sheaf of copying paper, is inputted in said operation section.

8. The image forming apparatus according to claim 1, wherein the sorting instruction to be accepted by said operation section includes a sheaf-unit sorting instruction to shift the first sheaf of copying paper from the position of the second sheaf of copying paper.

9. The image forming apparatus according to claim 1, wherein the sorting instruction to be accepted by said operation section includes a sheaf set-unit sorting instruction to shift a first set made up of the first sheaf of copying paper and the second sheaf of copying paper from the position of a second set made up of the first sheaf of copying paper and the second sheaf of copying paper.

10. The image forming apparatus according to claim 1, further comprising:

an original-paper placement portion on which original paper to be copied is placed;

a detecting means for detecting original paper being placed on said original-paper placement portion; and an operation displaying portion for displaying a guidance to guide an operation by a user;

wherein if said detecting means detects none of the first sheaf of original paper on the placement portion after the first sheaf of original paper is placed on said original-paper placement portion, said controlling section controls said operation displaying portion to display a guidance requesting a user if an image reading operation of the second sheaf of original paper is to be conducted or not, and when an instruction related to image forming operation of the second sheaf is inputted by a user through said operation section, said controlling section controls said data fetching means to fetch the second image data corresponding to the second sheaf of original paper.

11. The image forming apparatus according to claim 1, wherein said data fetching means optically reads images on sheets of original paper.

12. The image forming apparatus according to claim 1, wherein said data fetching means receives image data from an outside memory.

* * * * *